United States Patent [19]

Wycliffe

[11] Patent Number: 5,055,017

[45] Date of Patent: Oct. 8, 1991

[54] MECHANICAL PUMPS

[75] Inventor: Henryk Wycliffe, Crawley, United Kingdom

[73] Assignee: The BOC Group plc, Windlesham, England

[21] Appl. No.: 425,650

[22] Filed: Oct. 23, 1989

[30] Foreign Application Priority Data

Oct. 28, 1988 [GB] United Kingdom ..... 8825284

[51] Int. Cl.[5] ..... F04C 18/18; F04C 29/08

[52] U.S. Cl. ..... 418/183; 418/189; 418/206

[58] Field of Search ..... 418/77, 183, 189, 190

[56] References Cited

U.S. PATENT DOCUMENTS 2,058,817 10/1936 Northey ..... 418/183 X
2,097,037 10/1937 Northey ..... 418/206
2,289,371 7/1942 Lysholm et al. ..... 418/190
3,472,445 10/1969 Brown ..... 418/189
4,504,201 3/1985 Wycliffe ..... 418/9

FOREIGN PATENT DOCUMENTS 1335045 10/1973 United Kingdom .
1365563 9/1974 United Kingdom .
1365564 9/1974 United Kingdom .

*Primary Examiner*—Leonard E. Smith
*Assistant Examiner*—David L. Cavanaugh
*Attorney, Agent, or Firm*—Robert I. Pearlman; David M. Rosenblum

[57] ABSTRACT

A mechanical pump having a pumping chamber within which is positioned a pair of intermeshing rotors, preferably of the claw type, with each rotor mounted for rotation on respective shafts and the first rotor being associated with an inlet to the pumping chamber and the second rotor being associated with an outlet from the pumping chamber, wherein the second rotor has a cavity in its surface immediately adjacent the outlet.

4 Claims, 4 Drawing Sheets

MECHANICAL PUMPS

BACKGROUND OF THE INVENTION

The present invention relates to mechanical pumps and in particular to mechanical vacuum pumps incorporating at least one pair of intermeshing rotors, especially rotors of the type known as "claw" rotors.

When intermeshing claw type rotors are employed in mechanical vacuum pumps or compressors for use with gases or vapors which tend to condense or liquefy during the pumping or compression process, a hydraulic hammering effect is sometimes experienced. This hydraulic hammering effect is caused by the inability of the claw type rotors to expel liquid sufficiently rapidly from their swept volume The liquid thus accumulates to give the hammering effect which can lead to mechanical failure.

A typical claw type rotor mechanism is illustrated in FIGS. 1*a* to 1*d* of the accompanying drawings which shows a pair of rotors 5,8 mounted on respective shafts 1A, 1B for rotation about the shafts in the direction shown by the arrows with the claws 7,13 closely enain the walls of a chamber 10.

Any liquid formed in the volume swept by the rotors 5,8 or from vapor or entrained in gas entering through an inlet port 9 in the wall of the pumping chamber 10, tends to move radially outwards under centrifugal force towards the stator walls 2 away from the outlet port 3 which is located in the side wall 4 adjacent the centre of the rotor 5. The claws at their leading surfaces scoop the liquid as they rotate, and the claw 7 of the rotor 8 which is associated with the inlet port 9 throws the liquid towards the outlet port 3 as it rotates from the positions 1*a* through 1*b* to 1*c* of FIG. 1.

However, in the critical position between positions 1*b* and 1*c*, the outlet port 3 is closed and this prevents expulsion of the liquid from the pumping chamber 10. The liquid is thereby trapped between the rotors 5, 8 and creates an hydraulic hammering effect which can lead to mechanical failure of the pump.

SUMMARY OF THE INVENTION

The present invention is concerned with the provision a mechanical pump having at least one pair of intermeshing rotors in which any hydraulic hammering effect can be mitigated or prevented.

In accordance with the present invention, there is provided a mechanical pump comprising first and second intermeshing rotors, each rotor being mounted for rotation on respective shafts and located in a pumping chamber, an inlet to the pumping chamber with which the first rotor is associated and an outlet from the pumping chamber with which the second rotor is associated, and a cavity formed in the surface of the second rotor immediately adjacent the outlet.

The invention is primarily, but not exclusively, concerned with pumps having a "claw" type rotor profile. The nature of the cavity must be such that any condensed liquid which is present in particular in the volume of gas or vapor being "swept" by the rotors is urged into the cavity and ejected therefrom when the swept volume communicates with the chamber outlet.

Ideally, the pump is one in which the inlet to the pumping chamber is formed as a port in a first wall of the pumping chamber and the outlet from the pumping chamber is formed as a port in an opposite wall of the pumping chamber.

Preferably the cavity is positioned in a side of the second rotor which engages the wall of the chamber containing the outlet. Most preferably the position of the cavity is such that the condensed liquid is urged into the cavity by centrifugal force. In general the shape of the cavity is not important but preferably the shape is such that condensed liquid is retained within the cavity despite the rotation of the rotor and the centrifugal forces caused thereby. This can be achieved, for example, by arranging for the cavity to be substantially cup-shaped and extending in a direction such that centrifugally driven liquid is urged to the base of the cup before being deposited in the chamber outlet.

For the avoidance of any doubt, the pump may comprise a plurality of individual chambers each having its own pair of rotors, some or, preferably, all of which may have cavities in accordance with the invention.

In practice, it is generally preferable for the shafts on which the rotors are mounted to be orientated vertically. It is also preferable for the inlet to be positioned in a wall in the top of the chamber and for the outlet to be positioned in a wall at the bottom of the chamber.

BRIEF DESCRIPTION OF THE DRAWINGS

For a better understanding of the invention, reference will now be made, by way of example only, to the accompanying schematic drawings in which.

DETAILED DESCRIPTION

Figure 1A:
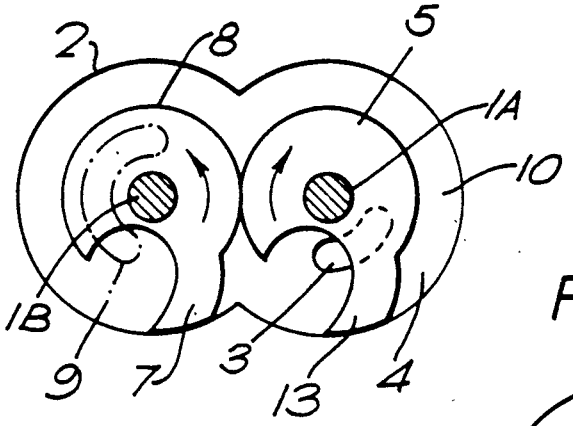
FIG. 1a PRIOR ART
FIGS. 1*a* to 1*d* are transverse cross-sectional sketches through a pumping chamber of a known mechanical pump employing intermeshing claw type rotors and illustrating different relative positions of the rotors during a pumping operation.
Figure 1B:
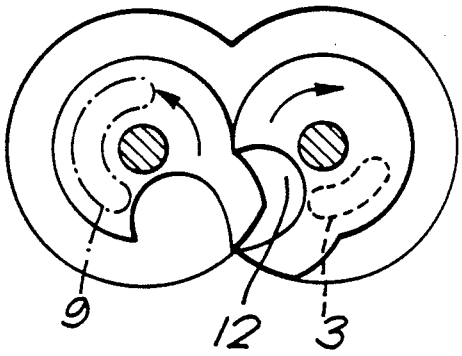
FIG. 1b PRIOR ART
Figure 1C:
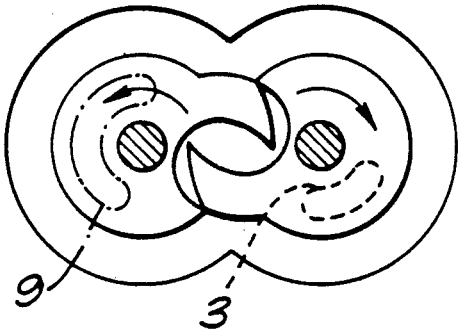
FIG. 1c PRIOR ART
Figure 1D:
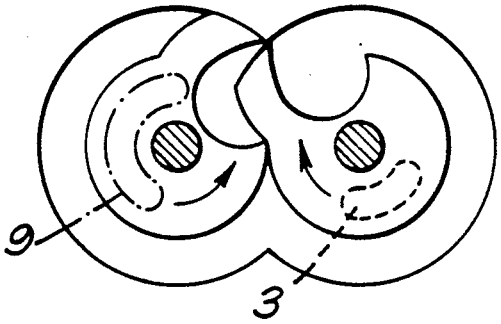
FIG. 1d PRIOR ART
Figure 2A:
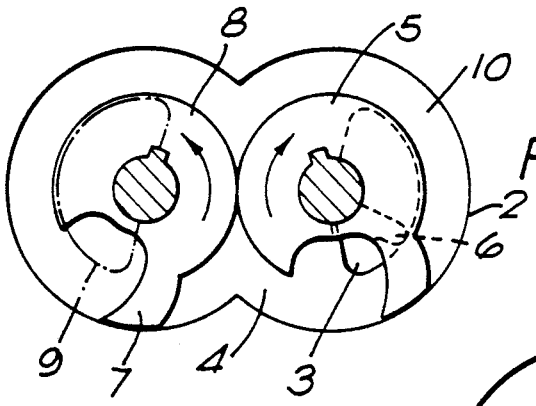
FIGS. 2*a* to 2*e* are transverse cross-sectional sketches through a pumping chamber of a mechanical pump employing intermeshing claw type rotors embodying the present invention and which illustrate different relative positions of the rotors during a pumping operation.
Figure 2B:
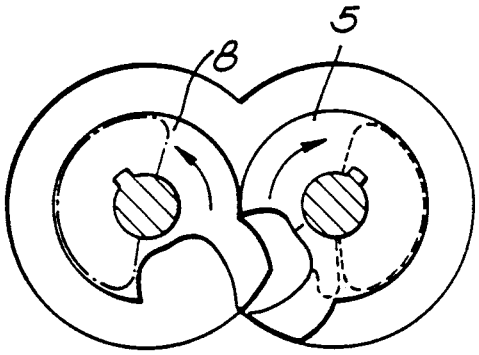
Figure 2C:
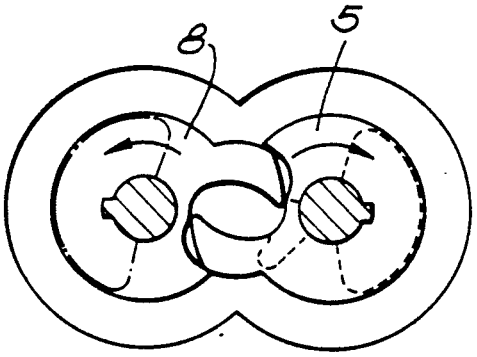
Figure 2D:
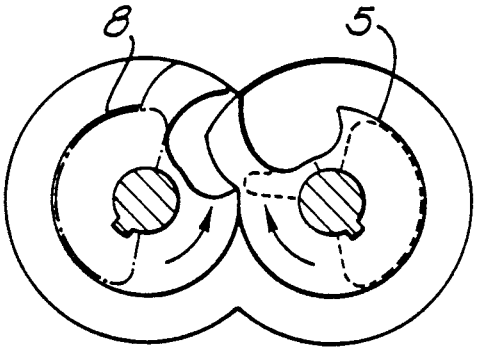
Figure 2E:
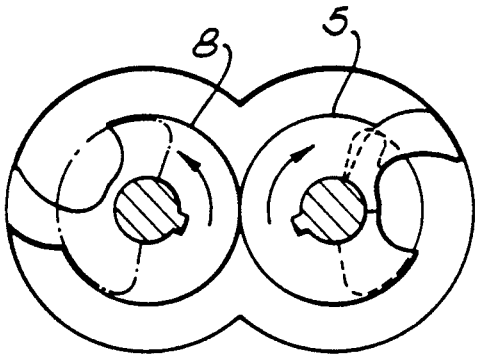
Figure 3:
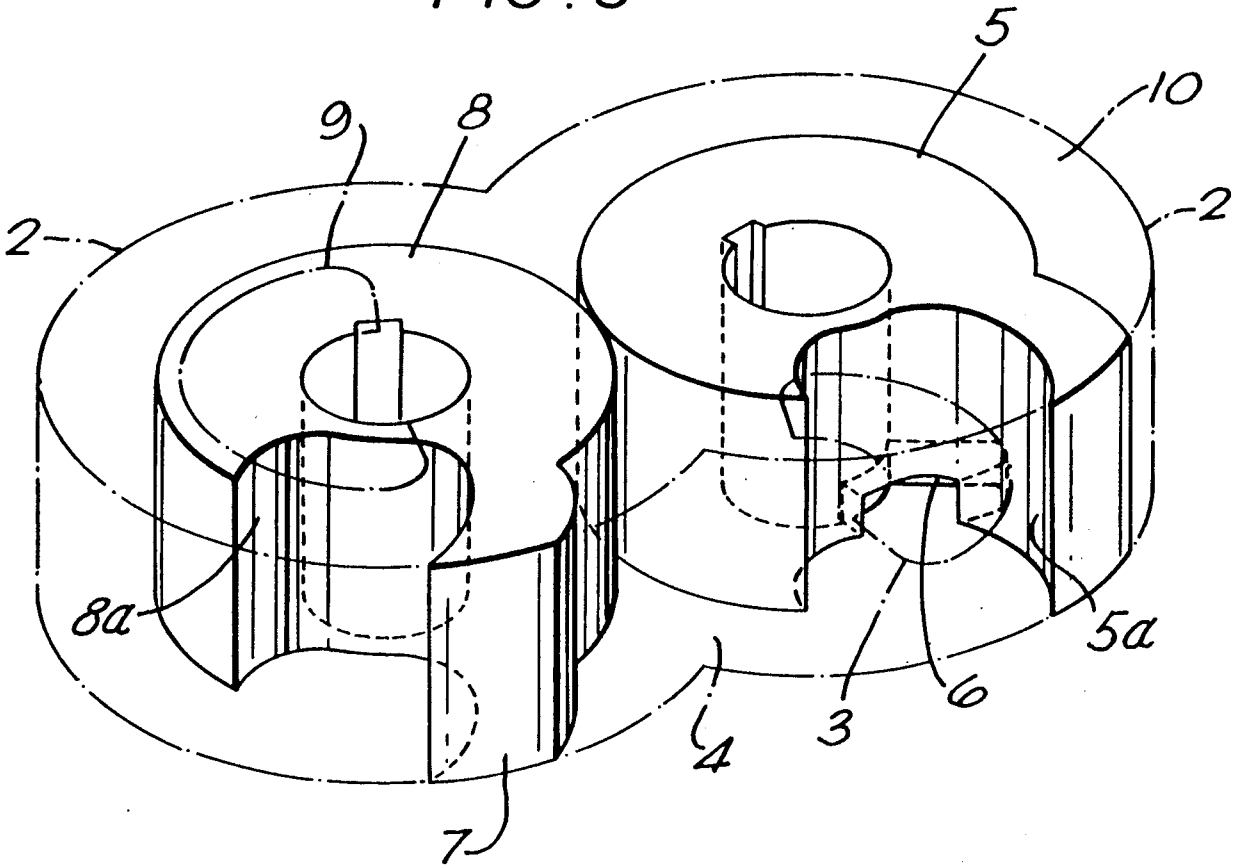
FIG. 3 is a perspective view of the rotors illustrated in FIG. 2*a*.

As shown in FIGS. 1*a* to 1*d*, the pumping chamber 10 of a mechanical pump contains intermeshing claw type rotors 5, 8 each mounted on a shaft (1A and 1B) in a manner known per se. The rotor 5 rotates in a clockwise sense as indicated by the arrows whilst rotor 8 rotates in an anti-clockwise sense. When used to pump a vapor which during the pumping operation condenses to a liquid, said liquid will be trapped in the space 12 between the rotors 5, 8 at a time when the outlet port 3 is closed. As a consequence, the liquid can create a hammering effect between the rotors 5, 8 which can lead to mechanical failure.

Referring now to FIGS. 2*a* to 2*e* and FIG. 3, the arrangement of the pumping chamber 10 and the rotors 5, 8 having leading surfaces 5*a* and 8*a* is substantially identical to that of the known mechanical pump and like parts will be identified by the same reference numerals.

The rotor 5 which is associated with the outlet port 3 is formed with an open-ended cavity 6 on its surface immediately adjacent the side wall 4 in which the outlet port 3 is formed and so as to communicate, at one end, with leading surface 5*a*. The shape and location of the cavity 6 and its relation to the outlet port 3 is illustrated in FIGS. 2*a* to 2*e* and FIG. 3.

When the shafts on which the rotors 5, 8 are located are in the vertical orientation, the liquid tends to collect under gravity on the bottom sidewall 4 in which the outlet port 3 is located. This liquid is thrown into the cavity 6 in position 2*b* to 2*c*, in particular by the action of claw 7 of rotor 8, and under centrifugal force is discharged into the outlet port 3 as it passes over it in the position 2*e* back to 2*a*. The cavity 6 expels a quantity of liquid, each revolution, sufficient to prevent build-up of liquid in the pumping chamber to such an extent that a hydraulic lock and resulting hammering could occur in position 2*b* to 2*c* between rotors 5 and 8. Cavity 6 also forms part of the outlet passage through which pumped gases, vapors and the liquid are discharged.

It will be appreciated that in a multi-stage claw type rotor pump which in its normal operative position has the axes of the rotors vertical, a cavity 6 is provided in the rotor face associated with the outlet port at each stage. In all cases, the position of the cavity is such that it does not interfere with the basic operation of the pump.

Figure 4A:
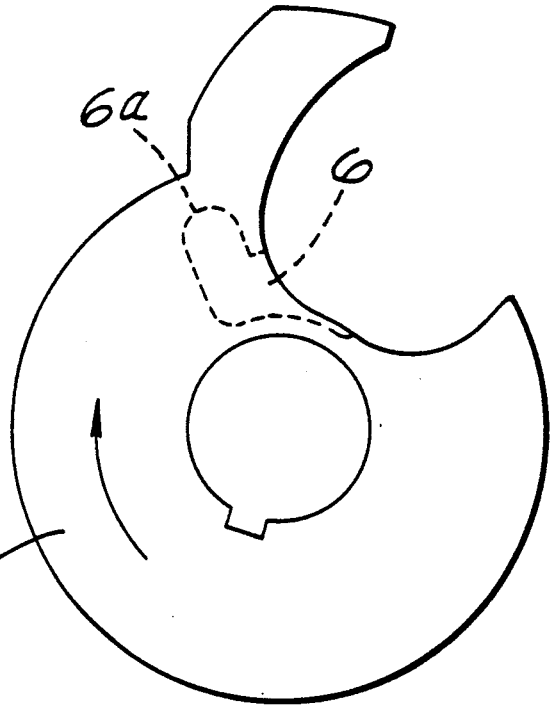
FIGS. 4*a* and *b* are top view of two separate rotors for use in pumps of the invention showing diiferently shaped cavities therein.
Figure 4B:
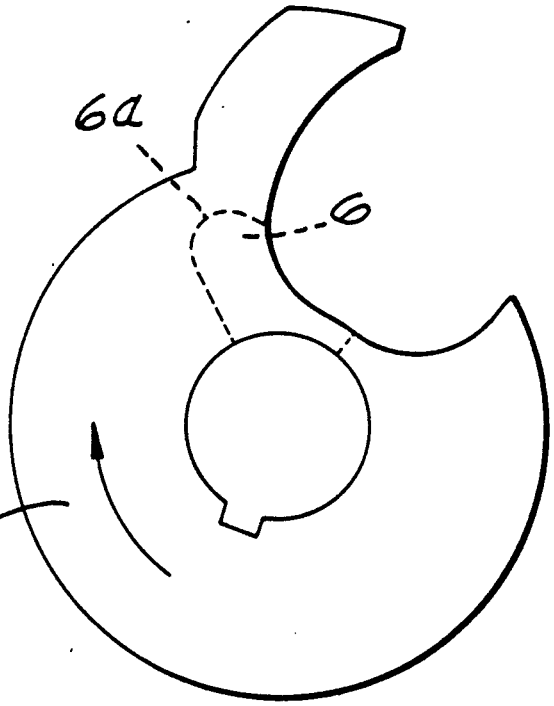

Finally, with reference to FIG. 4, there is shown two different shapes which can usefully be employed in pumps of the invention. Each of the cavities 6 have a cup-shaped portion 6*a* oriented to retain the liquid therewithin prior to ejection of the liquid into the outlet port 3.

I claim:

1. A mechanical pump suitable for pumping a volume containing a vapor and a liquid, the mechanical pump comprising: at least one pumping chamber having an inlet for receiving the volume within the pumping chamber and an outlet for discharging the volume from the pumping chamber; and a pair of intermeshing claw-type, first and second rotors mounted on respective shafts for rotation within the pumping chamber and having leading surfaces at which the volume is swept by the first and second rotors from the inlet to the outlet; the first rotor alternately opening and closing the inlet; and the second rotor alternately opening and closing the outlet and including an open-ended cavity, communicating, at one end, with the leading surface of the second rotor so that the liquid is urged into the cavity during the rotation of the second rotor and positioned so that the liquid is ejected from the cavity as the second rotor transverses the outlet, the open-ended cavity having a cup-shaped portion essentially radially oriented to retain the liquid prior to the ejection of the liquid from the open-ended cavity.

2. The pump of claim 1 in which the inlet is formed as a port in a first wall of the pumping chamber, and the outlet is formed as a port in a second wall of the pumping chamber, located opposite to the first wall.

3. The pump of claim 2, in which:

the rotor has a side which engages second wall of the pumping chamber and at which the outlet is opened and closed by the second rotor; and the open-ended cavity is defined in the side of the second rotor.

4. The pump of claim 3, in which the first and second walls of the pumping chamber have a horizontal orientation, and the shafts on which the first and second rotors are mounted have a substantially vertical orientation.

* * * * *